US005803460A

United States Patent [19]

Hesse

[11] Patent Number: 5,803,460

[45] Date of Patent: Sep. 8, 1998

[54] METHOD OF PLAYING A CARD GAME

[75] Inventor: Michael A. Hesse, Westlake Village, Calif.

[73] Assignee: Helix Information Services, Inc., Westlake Village, Calif.

[21] Appl. No.: 848,419

[22] Filed: May 8, 1997

Related U.S. Application Data

[63] Continuation-in-part of Ser. No. 546,293, Oct. 20, 1995, Pat. No. 5,645,281, which is a continuation-in-part of Ser. No. 442,057, May 16, 1995, abandoned.

[51] Int. Cl.[6] ..... A63F 1/00

[52] U.S. Cl. ..... 273/292

[58] Field of Search ..... 273/292, 274, 273/309; 463/12, 13

[56] References Cited

U.S. PATENT DOCUMENTS

| | | | |
|---|---|---|---|
| 5,013,049 | 5/1991 | Tomaszewski | 273/292 |
| 5,072,946 | 12/1991 | Miller | 273/292 |
| 5,154,429 | 10/1992 | LeVasseur | 273/292 |
| 5,257,810 | 11/1993 | Schorr et al. | 273/292 |
| 5,265,882 | 11/1993 | Malek | 273/292 |
| 5,275,415 | 1/1994 | Wisted | 273/274 |
| 5,275,416 | 1/1994 | Schorr et al. | 273/292 |
| 5,320,356 | 6/1994 | Cauda | 273/292 |
| 5,322,295 | 6/1994 | Cabot et al. | 273/292 |
| 5,328,189 | 7/1994 | Malek | 273/292 |
| 5,364,105 | 11/1994 | Jones | 273/292 |
| 5,368,305 | 11/1994 | Rodda et al. | 273/292 |
| 5,390,934 | 2/1995 | Grassa | 273/292 |
| 5,395,120 | 3/1995 | Malek | 273/292 |
| 5,411,268 | 5/1995 | Nelson | 273/292 |

OTHER PUBLICATIONS

Scarne, John, "Scarne's Encyclopedia of Games—Banking Card Games", 1973, Harper & Row Publishers, pp. 281,286.

"21st Century Blackjack", 1994, Casino Gaming Concepts, Inc.

*Primary Examiner*—Benjamin H. Layno
*Attorney, Agent, or Firm*—D'Alessandro & Ritchie

[57] ABSTRACT

A card game called "Newjack" is disclosed. Newjack is preferably played with between one to eight normal decks of playing cards, although a larger number of decks may be employed. Players play against each other rather than the house dealer. (Hence the game is not a banking game.) The players are trying to reach a card value total of between 22 and 30. Any player going over the card value total is given a second chance at winning and does not automatically lose. (Hence the game is not a busting game.) When the target value is 22, aces are always worth 1. Deuces are worth 2 or 12. Each numbered card is worth its face value and picture cards (King, Queen, Jack) are each worth 10. In Newjack, the player wagers against a designated player "Dealer". The designated Dealer is rotated throughout the game. The house collects a fixed amount from each player for each hand. Each player other than the Dealer is dealt two cards. The Dealer is dealt one card. The player's cards are dealt face down. The Dealer's card is dealt face up. Each player has the option to SHOW (a natural 22), STAND, HIT, DOUBLE, or SPLIT. After all the players have acted, the Dealer is dealt a second card face up. The Dealer chooses whether to hit or stand. Ties may be decided by the number of cards drawn. For example, if the hand totals for both hands are 19, then a three-card 19 beats a two-card 19. Jackpots can be provided, even to players with losing hands.

19 Claims, 10 Drawing Sheets

METHOD OF PLAYING A CARD GAME

RELATED APPLICATIONS

This application is a continuation-in-part of U.S. patent application Ser. No. 08/546,293, filed Oct. 20, 1995, now U.S. Pat. No. 5,645,281, which is a continuation-in-part of U.S. patent application Ser. No. 08/442,057, filed May 16, 1995, now abandoned.

BACKGROUND OF THE INVENTION

1. Field Of The Invention

The present invention relates to gaming and to card games. More particularly, the present invention relates to a card game called "Newjack" in which a number of players play against one another or against a "house".

2. The Prior Art

Numerous card games are known in the prior art. Some card games are predominantly games of skill, in which a player's skill significantly increases his or her chance of winning. Other card games are predominantly games of chance in which winning or losing depends on the random chance of a certain card being turned rather than on the skill of the player.

There are three wagering formats common in card games involving wagering. The first is known as wagering against the house (the Nevada model). The second is wagering for a common pool (the Poker model). The third format comprises wagering against a designated player (the California model).

In Nevada, most wagering is against the house or casino. In blackjack, for example, each player is dealt a hand, and a hand is dealt for the casino. If the player loses, the casino collects the money. If the player wins, the casino pays the player. The casino makes money when the players lose more than they win.

This type of wagering is currently illegal in states such as California, due to a statutory prohibition of "banking" games. Under present California law, the gaming establishment can hold no interest in the outcome of a wager.

In Poker, the players never wager against the house. They are playing against each other. All the wagers are placed in a common pool (the pot), and the player with the best hand wins all the money wagered on that deal.

In Poker type games, the gaming establishment makes money by taking a "Collection." This is a fee collected by the gaming establishment either for each hand or for each half-hour of play. In Nevada, the collection may be a fixed amount or a percentage of the pool. In California, the collection must be a fixed amount (except for pari-mutuel horse racing). A typical collection could be $1 for each hand, charged to each player. A typical time collection might be $8 per half hour for a poker game where the bets and raises are limited to $30. In California this method of wagering is mostly used for poker and pan (a form of rummy).

Pai Gow, a Chinese wagering game played with tiles, introduced a new wagering model to California. It is something of a hybrid between the other two models. For each hand one of the players is designated the "Dealer," and all of the other players are trying to beat the Dealer.

On every hand dealt, each player is trying to beat the Dealer. If the player beats the Dealer, the player wins and is paid off from the Dealer's wager. If the Dealer has a better hand than the player, the Dealer wins the player's wager.

Each player has the option to play the role of Dealer. Typically, a player is Dealer for two hands. Then the option is offered to the next player on the left who can become Dealer or pass the option on. There are other equivalent ways to handle the Dealer option with respect to direction of pass (i.e., rotate to the right, etc.) and duration of Dealer status (i.e., one, three, or more hands).

The Dealer is not bound by any table limit. The Dealer frequently bets enough to cover the total bets of all of the players at the table. However, the Dealer is not required to make any bet other than the table minimum.

On every hand, dice are shaken and the order of payoffs is determined. This decides how the wagers are settled if the Dealer is not wagering enough money to cover all the bets made by the other players. An alternative method is to always start payoffs with the player on the Dealer's left.

The Dealer does not actually deal the cards or settle wagers the way a Nevada blackjack dealer would. These functions are handled by a gaming establishment employee, commonly called the "House Dealer." Throughout this document, the term "Dealer" will refer to the player, against whom the others are wagering. The term "House Dealer" will refer to the gaming establishment employee who actually deals the cards and runs the game.

Numerous states have restrictions on the legality of card games. For example, California gaming law has several restrictions on which card games are legal. Certain games are prohibited. Banking games are among the games which are prohibited. Games that are not predominately games of skill are also prohibited.

One of the games specifically prohibited is the well-known game entitled "blackjack" or "21", referred to previously. Blackjack is a card game played against a dealer in which each player tries to achieve a total card value of equal to or less than 21 but more than the total value of the cards dealt to the dealer. Numbered cards are worth their face number. Aces are worth either 1 or 11 and picture cards are worth 10. Two cards are initially dealt to each player including the dealer. Each player can request one or more additional cards. Any hand with a total value of over 21 loses. The dealer (the house) wins any ties.

A key element of the game of blackjack is "busting." A player whose hand total exceeds 21 is said to have "busted." His/her hand automatically loses and (s)he is to turn the hand in immediately and forfeit his/her bet. Some law enforcement agencies have identified busting as a key element of blackjack and have asserted that any game with busting is illegal in a jurisdiction that prohibits blackjack.

Another key element of the game of blackjack is a bonus paid for a "Blackjack" or "natural." If a player gets a perfect hand on the first two cards, this is paid a bonus of half of the original bet above winning the amount of the original bet. So, for example, a player who bets $10 and gets a Blackjack or natural wins $15. Some law enforcement agencies have identified paying bonuses on naturals as a key element of blackjack and have asserted that any game with bonuses is illegal in a jurisdiction that prohibits blackjack.

It is an object of the present invention to provide an enjoyable card game.

It is a further object of the present invention to provide a card game which may be legally played in some states having legal gaming restrictions.

It is a further object of the present invention to provide a card game which may be legally played in some states having legal gaming restrictions against banking type games, games with busting, or games with bonuses.

BRIEF DESCRIPTION OF THE INVENTION

According to a preferred embodiment of the present invention a card game referred to as "Newjack" is disclosed.

Newjack is a game of skill and is preferably played with between one to eight normal decks of playing cards, although a larger number of decks may be employed.

Players play against each other rather than the House Dealer. (Hence the game is not a banking game.) It is, however, contemplated that the game of the present invention can be played against a House Dealer. The players are trying to reach a card value total of 22. Aces are always worth 1. Deuces are worth 2 or 12. Each numbered card is worth its face value and picture cards (King, Queen, Jack) are each worth 10.

In Newjack, the player wagers against a designated player, the Dealer. The designated Dealer is rotated throughout the game. The house collects a fixed amount from each player for each hand.

Each player other than the Dealer is dealt two cards. The Dealer is dealt one card. (The Dealer's hand is completed later.) The player's cards are dealt face down. The Dealer's card, is dealt face up. Each player has the option to SHOW (a natural 22), STAND, HIT, DOUBLE, or SPLIT.

After all the players have acted, the Dealer is dealt a second card face up. The Dealer chooses whether to hit or stand. Although there may be restrictions on the Dealer's play, it is not completely determined by fixed rules. If played correctly, there are fewer "pat hands" than in blackjack. There will be more hitting and doubling. This means that the outcome of the hand will more often be decided later, adding excitement. Alternatively, the Dealer may be dealt two cards, one face up, at the same time the player's cards are dealt.

As an option, ties may be decided by the number of cards drawn. For example, if the hand totals for both hands are 19, then a three-card 19 beats a two-card 19. This means there will be fewer "pushes" where no money changes hands and more incentive to hit when it is a close call.

As an optional feature of the game of the present invention, jackpots can be provided, even to players with losing hands.

DETAILED DESCRIPTION OF A PREFERRED EMBODIMENT

Figure 1:
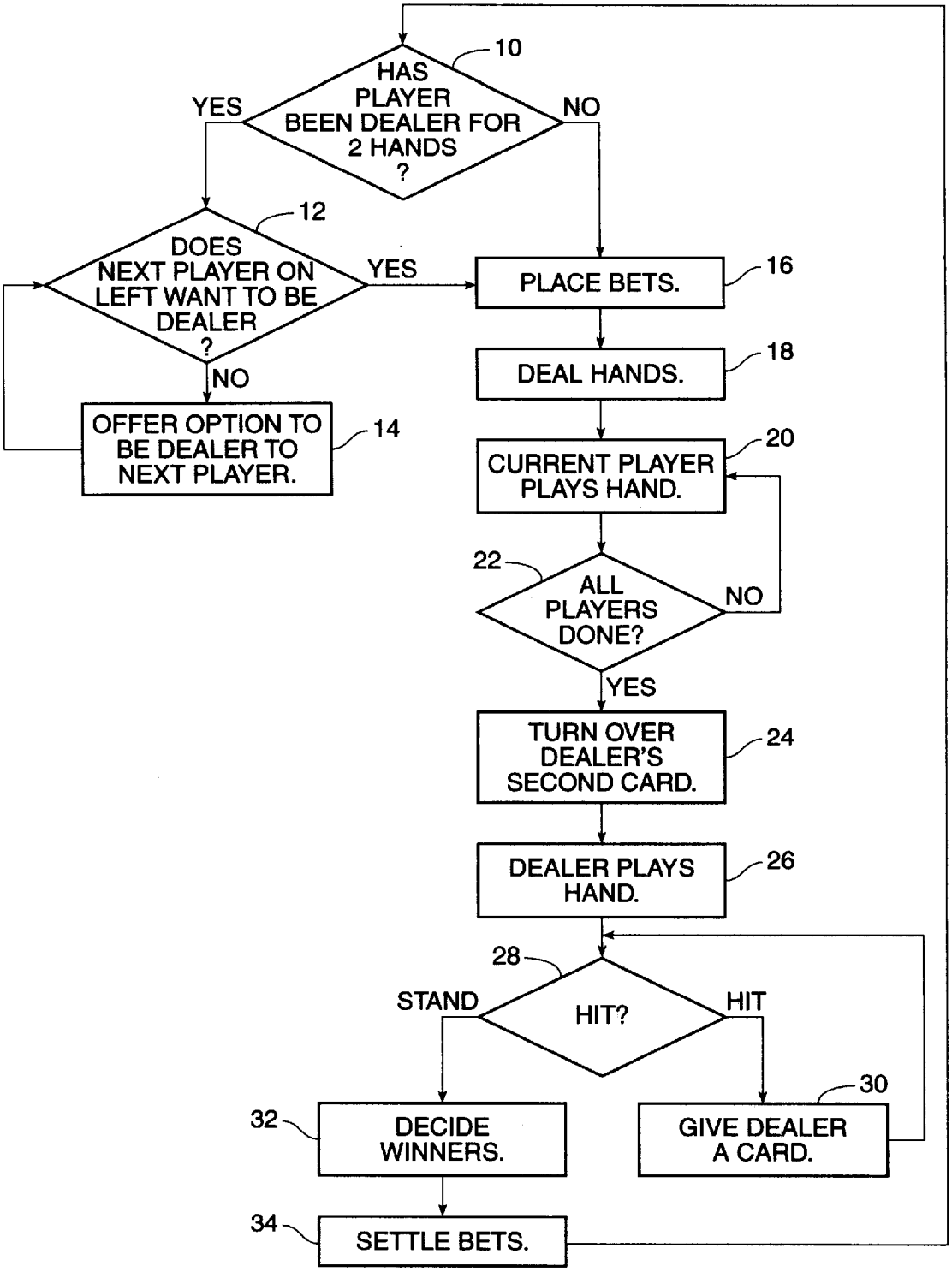
FIG. 1 is a flow chart of play of the game Newjack according to a presently preferred embodiment of the present invention.

Those of ordinary skill in the art will realize that the following description of the present invention is illustrative only and not in any way limiting. Other embodiments of the invention will readily suggest themselves to such skilled persons.

The game of Newjack is played with one or more decks of regular playing cards. According to a presently preferred embodiment of the game, one to eight decks are used, although it will be readily recognized that other numbers of decks could be employed. According to a presently preferred embodiment of Newjack, jokers are not utilized, although they could be in variations of the game according to the present invention.

In the game of Newjack, players play against each other rather than against a House Dealer. Hence the game is not a banking game specifically prohibited in states such as California. One player is designated as Dealer for each hand. However, as previously mentioned, in one embodiment of the game of the present invention, the game may be played against a House Dealer.

The object of the game is for the player to beat the Dealer or for the Dealer to beat the Player. The player wins by getting a hand higher than the Dealer and as close to a target numerical value as possible without going over the target numerical value. If the player goes over the target numerical value ("busts"), the player automatically loses unless (s)he and the Dealer have the same numerical hand value.

According to a presently preferred embodiment of the game of the present invention, the number of cards in each hand at the beginning of play is two, however those of ordinary skill in the art will readily recognize that the number of cards in each hand at the beginning of play could be one or more than two if desired without departing from the spirit of the invention disclosed herein.

According to a presently preferred embodiment of the game of the present invention, 22 is the target numerical value. Most of the illustrative disclosure of the game herein will be with reference to such preferred embodiment, but conversion to a target numerical value other than 22 will be intuitively obvious to even the most casual observer.

When the total card value which is sought by each player is 22, the quantity of each card in the deck as well as its value in play is shown below in Table I:

TABLE I

| CARD | QUANTITY | CARD VALUE |
|---|---|---|
| Ace | 4 | 1 |
| 2 | 4 | 2 or 12 |
| 3 | 4 | 3 |
| 4 | 4 | 4 |
| 5 | 4 | 5 |
| 6 | 4 | 6 |
| 7 | 4 | 7 |
| 8 | 4 | 8 |
| 9 | 4 | 9 |
| 10 | 4 | 10 |
| J | 4 | 10 |
| Q | 4 | 10 |
| K | 4 | 10 |

Those of ordinary skill in the art will recognize that other combinations are possible which remain within the spirit and scope of the present invention. For example, in other embodiments of the game of the present invention, the target numerical value of the cards may be 23–29. In such embodiments of the present invention, Table II below shows the presently preferred variation in card values from the values shown in Table I for the various target numerical values:

TABLE II

| TARGET NUMERICAL VALUE | CARD | CARD VALUE |
|---|---|---|
| 23 | 3 | 3 or 13 |
| 24 | 4 | 4 or 14 |
| 25 | 5 | 5 or 15 |
| 26 | 6 | 6 or 16 |
| 27 | 7 | 7 or 17 |
| 28 | 8 | 8 or 18 |
| 29 | 9 | 9 or 19 |

While the examples in this specification are given with the assumption that the target numerical value of the game is 22, those of ordinary skill in the art will be able to readily recognize the differences which will occur when target numerical values above 22 are employed.

If played correctly, there are fewer "pat hands" than in blackjack. There will be more hitting and doubling. This means that the outcome of the hand will more often be decided later, adding excitement.

Optionally, ties of cards in two hands where the total numerical value below the target numerical value may be decided by the number of cards drawn. For example, if the hand totals for both hands are 19, then a three-card 19 beats a two-card 19. This means there will be fewer "pushes" where no money changes hands and there is more incentive to hit when it is a close call.

In Newjack, the player wagers against a designated player, the Dealer. Each player has the option to play the role of Dealer. Typically, a player is Dealer for one or two hands. Then the option is offered to the next player on the left who can become Dealer or pass the option on. There are other equivalent ways to handle the Dealer option with respect to direction of pass (i.e., rotate to the right, etc.) and duration of Dealer status (i.e., three, or more hands). The house may collect a fixed amount from each player for each hand. There is an advantage to being the Dealer. The size of the advantage varies with the number of decks used and various house rules. Assuming perfect play, the Dealer will win at a rate of somewhere between 0.5% and 1.5% of the money wagered. This is important, since there will be no game if no one wants to be the Dealer.

A key element of the game is how a winner is chosen if both the player and Dealer go over the target of 22.

In the preferred embodiment, if both the player and Dealer go over 22, the Dealer wins. As another option, if both Dealer and player go over 22, and they tie, the player gets his/her bet back, but the Dealer wins in all other cases where the player goes over 22. As another option, if both the Dealer and the player go over 22 and tie, then the player wins, but the Dealer wins in all other cases where the player goes over 22.

As another option, if both the Dealer and the player go over 22, then the one with the greater number of cards wins. If both the Dealer and the player have the same number of cards in their hands, then the hand results in a push. Alternatively, the Dealer could win or the player could win if both the Dealer and the player have the same number of cards in their hands.

Another option uses two targets, such as 22 and 32. If a player's hand value exceeds 22, the player may now try to get as close to 32 as possible without exceeding the target value. If the Dealer does not go over 22, the Dealer wins. If the Dealer goes over 22, then, as between the Dealer and the player, the party with the hand closer to 32 wins. Both parties may draw additional cards after they go over 22 to try to get closer to 32.

One additional option is to have a second contest to decide the winner if both parties go over the target. For example, each party could draw one additional card. The party who draws the higher (or lower) card could be declared the winner. Ties could go to the player, the Dealer, or be pushes.

If two players have hands with the same value and number of cards, the hand is a "Push" and no money exchanges hands.

A "Natural 22" consists of a two-card 22. Naturals are 2-10, 2-J, 2-Q, and 2-K. A natural 22 beats any hand except another natural.

If a player has a natural 22 and the Dealer does not, the player wins, for example, $3 for every $2 wagered or $7 for every $5 wagered.

As another option a bonus is paid only when a player and the Dealer tie on the target of 22. This bonus can be paid on all ties on the target or only if one or the other or both of the parties have drawn cards. The resulting options are: 1) pay on all ties on the target; 2) pay only if the player has drawn cards and they tie on the target; 3) pay only if the Dealer has drawn cards and they tie on the target; or 4) pay only if both the Dealer and the player have drawn cards and they tie on the target.

These options for paying bonuses allow the casino to make small adjustments in the advantage that one side has over the other. If no one wants to be the Dealer, then the casino can increase the Dealer's advantage. If no one wants to play against the Dealer, then the casino can use a different one of these options to reduce the Dealer's advantage.

According to a presently preferred embodiment, the play of the game in Newjack proceeds in the order of the following steps:

1. Each player puts out his/her bet.

2. Each player places the collection in a separate square.

3. Dice are shaken in a cup to determine the order of payoffs.

4. Each player other than the Dealer is dealt two cards. The Dealer is dealt one card. (The Dealer's hand is completed later.) The player's cards are dealt face down. The Dealer's card is dealt face up. According to another option, the Dealer's hand may be completely dealt at this time.

5. Each player has five options at this point in the game:

SHOW: If the player has a natural 22, (s)he turns over the cards and shows the hand. This is an automatic winner unless the Dealer also has a natural 22

HIT: If a player believes (s)he can improve the hand with another card, (s)he may hit. When a player hits, (s)he receives another card face up. The player may hit as often as (s)he likes. If a player goes over 22, the hand is an automatic loser unless that player ties with the Dealer.

SPLIT: According to an option of the game of the present invention, the player may SPLIT a hand if the first two cards are a pair. A pair is two cards of the same denomination. (The suit does not matter.) 8-8 is a pair. K-K is a pair. K-Q is not a pair. To split the player turns over the two cards and places a second wager on the table equal to the first wager. A card is dealt face down on each card in the pair turning each into a separate hand. Each of the two hands is played in turn, just like a normal hand. After splitting pairs, a natural 22 is an automatic winner, but does not pay $3 for each $2 wager. A natural 22 after a split pays $1 for each $1 wagered.

DOUBLE: If the player chooses to double, (s)he places UP TO the original bet amount out and takes one more card. The new card is dealt face down and remains untouched until the end of the action. A player may only double on his/her first two cards. Once a player hits, (s)he may no longer double.

STAND: At any time a player may choose to play his/her hand as it is. This is called "standing."

6. After all the players have acted, the Dealer is dealt a second card face up.

7. The Dealer has two options; HIT or STAND, as defined above. The Dealer may hit as often as (s)he chooses. Once the Dealer stands, the action on the deal is complete.

8. The House Dealer turns over any face-down cards and settles the wagers on each hand in order to the extent that Dealer's money covers the bets.

If the Dealer does not have enough money cover a player's bet, the player is given a "Free Play" button or other token, which is good for his/her next collection.

A common feature of most card games is "bad-beat" jackpots. If a player makes a very good hand and still loses, the player wins a jackpot. For example, in many poker games, a player who loses with a full house with three aces (Aces Full) wins a jackpot. Jackpots can be fixed or progressive. A fixed jackpot is a fixed amount. For example a player may win $5,000 every time (s)he qualifies. A progressive jackpot starts at a certain amount and increases until it is won. Then the jackpot returns to its starting amount and builds up again.

Newjack can be played with two jackpots. The Easy Jackpot is relatively easy to hit and pays a smaller amount. The progressive Super Jackpot will be hit substantially less often and will pay a larger amount.

Examples of jackpot options which may be included in Newjack according to the present invention are:

A player or Dealer makes a five-card 22 and loses to a natural 22.

A player or Dealer makes a six-card 22 and loses to a natural 22.

A player or Dealer makes a five-card 22 and loses to a six-card 22.

A player or Dealer makes a six-card 22 and loses to a seven-card 22.

A player or Dealer makes a six-card 22 and loses.

A player makes a six-card 21 and loses when the Dealer draws cards.

A player makes a seven-card 21 and loses when the Dealer draws cards.

Those of ordinary skill in the art will recognize that, when playing to target numerical values other than 22, the numerical values in the examples above will change according to the selected target numerical value.

According to the present invention, jackpots may be set up in either of two ways. In a first option, the full jackpot could be paid to the player who loses. According to a second option, the jackpot is only paid when a player loses and is divided between the player and the Dealer. Typically the Dealer would be paid 20% of the jackpot and the player would be paid 80%.

The jackpot is paid by the house, but to be legal in states such as California, the house may not make money on the jackpot wagering. All money collected from the player for the jackpot is kept by the gaming establishment in a separate account and must all be paid back to the player in jackpot winnings. The house may keep only an amount sufficient to cover their expenses in managing the jackpots and the jackpot pool.

The house may collect money from the player for the jackpot pool. There are three options. As a first option, a fixed amount may be collected from each player for each hand. As a second option, a fixed amount is collected from the Dealer on each hand to cover the jackpot for the whole table. Finally, as a third option, the jackpot can be an optional bet and only those players who place the jackpot bet win if a jackpot is hit.

In the gaming industry each gaming establishment prefers to run a game its own way. In addition, market conditions and legal issues in each locale can affect the set of rules to adopt. The game of Newjack according to the present invention may be played with numerous options.

The gaming establishment may offer the game of the present invention with any number of decks. Some may prefer a single-deck game. Others may prefer many decks dealt out of a shoe. Typical options would be one, two, four, six and eight decks. Other deck options could include adding or deleting cards from the deck or adding one or two jokers per deck. The jokers could be given a defined card value, could be designated as a jackpot, etc.

One Newjack option is to use the number of cards in the hand to decide the winner if two or more hands have the same value. According to this option, the player with the most cards in his/her hand wins if both the player and Dealer have a hand with the same value. For example, if the player has 5-5-K, the total card value is 20. If the Dealer has Q-10, the total card value is also 20. However, if this option is employed, the player wins because a three-card 20 beats a two-card 20.

Another option is for the player's hands to-be dealt face up instead of face down. This game is easier to run, since the players do not handle the cards, eliminating many options for cheating. If played this way, the Dealer would not be able to choose whether to hit or stand. His/her play would be automatic, the Dealer being required to hit until his/her hand reaches a predetermined total, such as 18.

Another option is what is sometimes called "double exposure." In this case both of the Dealer's cards are dealt face up before the player acts on his/her hand. This gives the player a significant advantage, since (s)he knows much more about the Dealer's hand before acting. To compensate for the player's advantage with this option, the Dealer wins all ties and Naturals pay a lower amount (e.g. $1 for each dollar wagered).

Yet another option is referred to as "Second Chance". If a player goes over 22, and the Dealer also goes over 22 and they tie, the player gets his/her bet returned to him/her.

A further option is to give the player the option to Surrender. If a player does not like his/her hand, (s)he can choose to give up half of his/her original bet, but get half of his/her original bet back. The player must surrender before taking any other action on his/her hand.

There are two types of surrender. According to the first type, known as "Early Surrender", a player may surrender his/her hand before the Dealer looks at his/her hole card. When a player invokes Early Surrender, (s)he gets half of his/her bet back regardless of what the Dealer does. According to the second type of surrender, known as "Late Surrender", a player may surrender his/her hand after the Dealer looks at his/her hole card. When a player invokes Late Surrender, (s)he gets half of his/her bet back only if the Dealer does not have a Natural. "Insurance" is another player option. If the Dealer has a 2 as his/her up-card (when playing to a target numerical value of 22), the player may make a bet of up to half his/her original bet that the Dealer has a Natural. If the Dealer has a Natural, the player is paid 2 to 1 ($2 won for every $1 wagered). Otherwise the player loses the insurance bet.

If the Dealer has a Natural, the winnings on the insurance wager offset the amount the player loses on the original wager. The player breaks even on the hand. This is why the wager is called "insurance."

Another option is whether the player may double after splitting a pair. After the player splits a pair, (s)he may like his/her hand and wish to double. Doubling comprises doubling the size of the bet and taking an additional card. Some gaming establishments may wish to allow this to create more action. Others may wish to simplify play and not allow it. Both options are part of the game.

Some gaming establishments may choose to limit the players'and Dealer's options. They may allow doubling only on certain hands, or not allow the player to hit hands above a certain value. Other gaming establishments may allow the player to make decisions freely. All of these options are part of the game.

There are several options regarding the Dealer's second card, often called the "hole card." The card may be dealt immediately or after all the players have acted. Also the Dealer may "peek" at the card when there is a possible Natural.

Every player starts with two cards. However, some gaming establishments will prefer to not give the Dealer his/her second card until after all the players have completed action on their hand. This makes it less likely that a cheating player will find a way to see the card before they act. Other gaming establishments would deal the second card immediately, and face-down. Either option may be part of the Newjack game.

If the gaming establishment gives the Dealer his/her second card immediately, they may have the Dealer look at the card without showing it to anyone else at the table. They would do this when the Dealer might have a Natural. The speeds up the action, since all the players'actions do not change the outcome when a Dealer has a Natural. The game includes the Dealer looking at the second card or not looking at it.

The play of Newjack according to the present invention may be easily understood with reference to FIGS. 1 through 4 and 6 through 8, which comprise flow charts illustrating the progress of the game.

Referring now to FIG. 1, a flow chart of play of the game Newjack according to the present invention is presented. First, the Dealer is chosen. At step 10, it is determined whether the current Dealer has been Dealer for more than a predetermined number of hands. As presently preferred, two hands is the predetermined number. If the present Dealer has been Dealer for the predetermined number of hands, a new Dealer is selected by a predetermined protocol. As shown in steps 12 and 14, the predetermined protocol is to offer Dealer status to the next player to the Dealer's left until a player accepts the option to be Dealer. Those of ordinary skill in the art will recognize that other protocols could be used as well.

Once a new Dealer is chosen as a result of steps 12 and 14, or if it has been determined at step 10 that the present Dealer has not been Dealer for the predetermined number of hands, play proceeds to step 16, where bets are placed by the Dealer and the players. Next, at step 18, hands are dealt. The player's hands are each dealt with both cards face down and the Dealer's hand is dealt with a first card face up and a second card face down.

At step 20, the current player plays his/her hand. As shown in step 22, step 20 is repeated for all players. Next, at step 24, the Dealer's second card is turned over. At step 26, the Dealer's hand is played. The play of the Dealer's hand is shown in steps 28 and 30. In step 28, the Dealer decides whether to "hit" (take a card). If so, the card is dealt at step 30. After step 30, the Dealer again may chose to hit at step 28. When the Dealer finally decides at step 28 to "stand", play proceeds to step 32, where the winners are determined. Finally, at step 34, the bets are settled, the game is over, and play returns to step 10 for a new hand.

Figure 2:
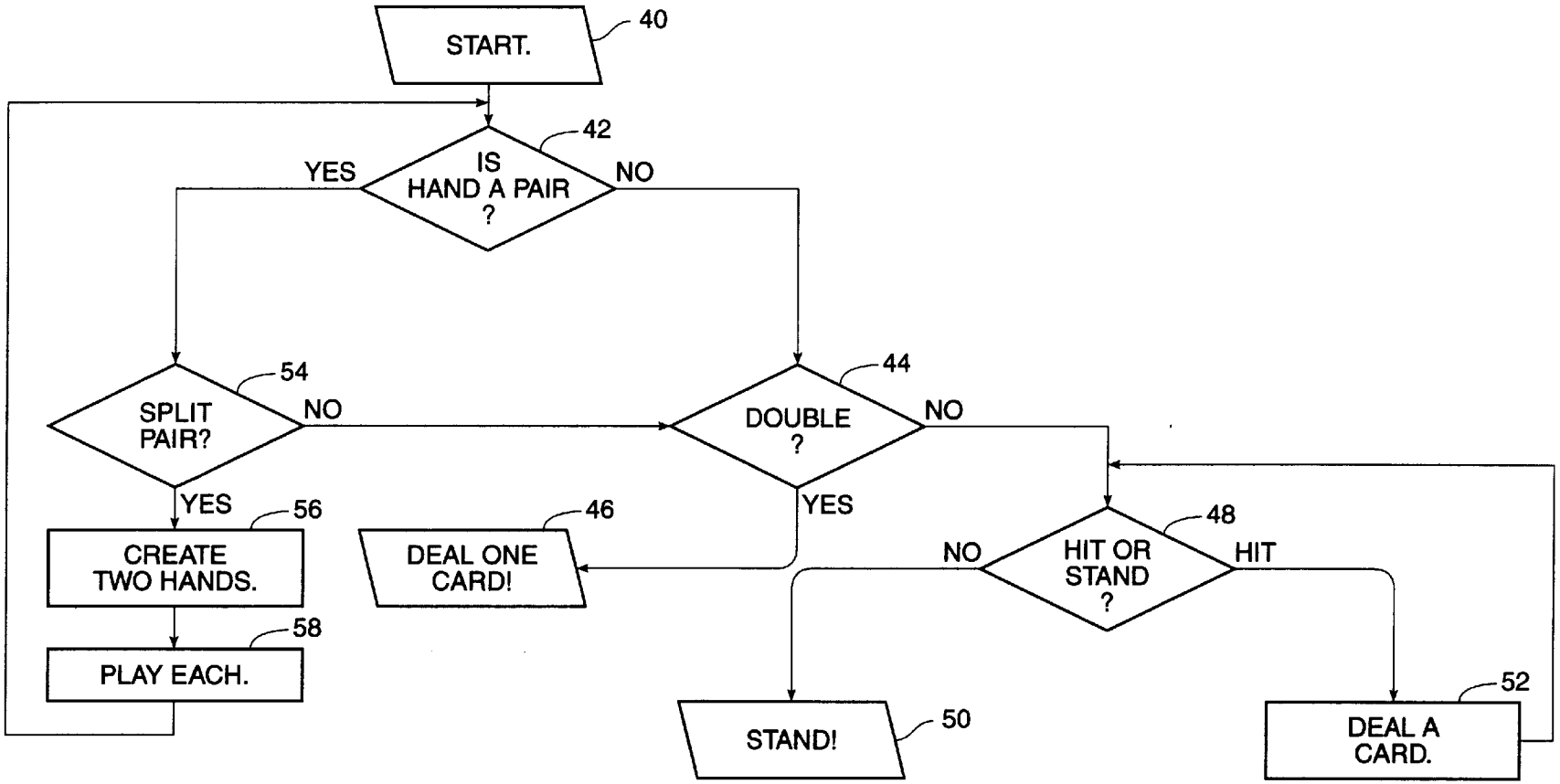
FIG. 2 is a flow chart illustrating in detail the playing of hands according to a presently preferred embodiment of the present invention.

Referring now to FIG. 2, a flow chart illustrates in detail the playing of hands at step 20 of FIG. 1. Play starts at step 40 and proceeds to step 42, where it is determined if the hand is a pair. If the hand is not a pair, play proceeds to step 44, where the player may decide to "double". If the player decides to double, (s)he is dealt one card at step 46, where play ends. If the player decides not to "double", play proceeds to step 48, where the player decides to "hit" or "stand". If the player decides to "stand", play ends at 50. If the player decides to "hit", a card is dealt at step 52 and play returns again to step 48, where the player again decides to "hit" or "stand". This loop between steps 48 and 52 continues until a decision is made to "stand", whereupon play transfers to the next player.

If at step 42, the hand is a pair, play proceeds to step 54, where the player may decide to split the pair into two hands. If the player decides not to split the pair, play proceeds to step 44, where the player may decide to double and play proceeds as described above. If the player decides to split the pair, play proceeds to step 56, where two hands are created from the pair of cards by dealing one new card on each of the pair of cards. After the two new hands are created at step 56, play proceeds to step 58, where each of the two hands are played in turn by returning to step 42, where it is determined if the hand is a pair and play proceeds as described above.

Figure 3:
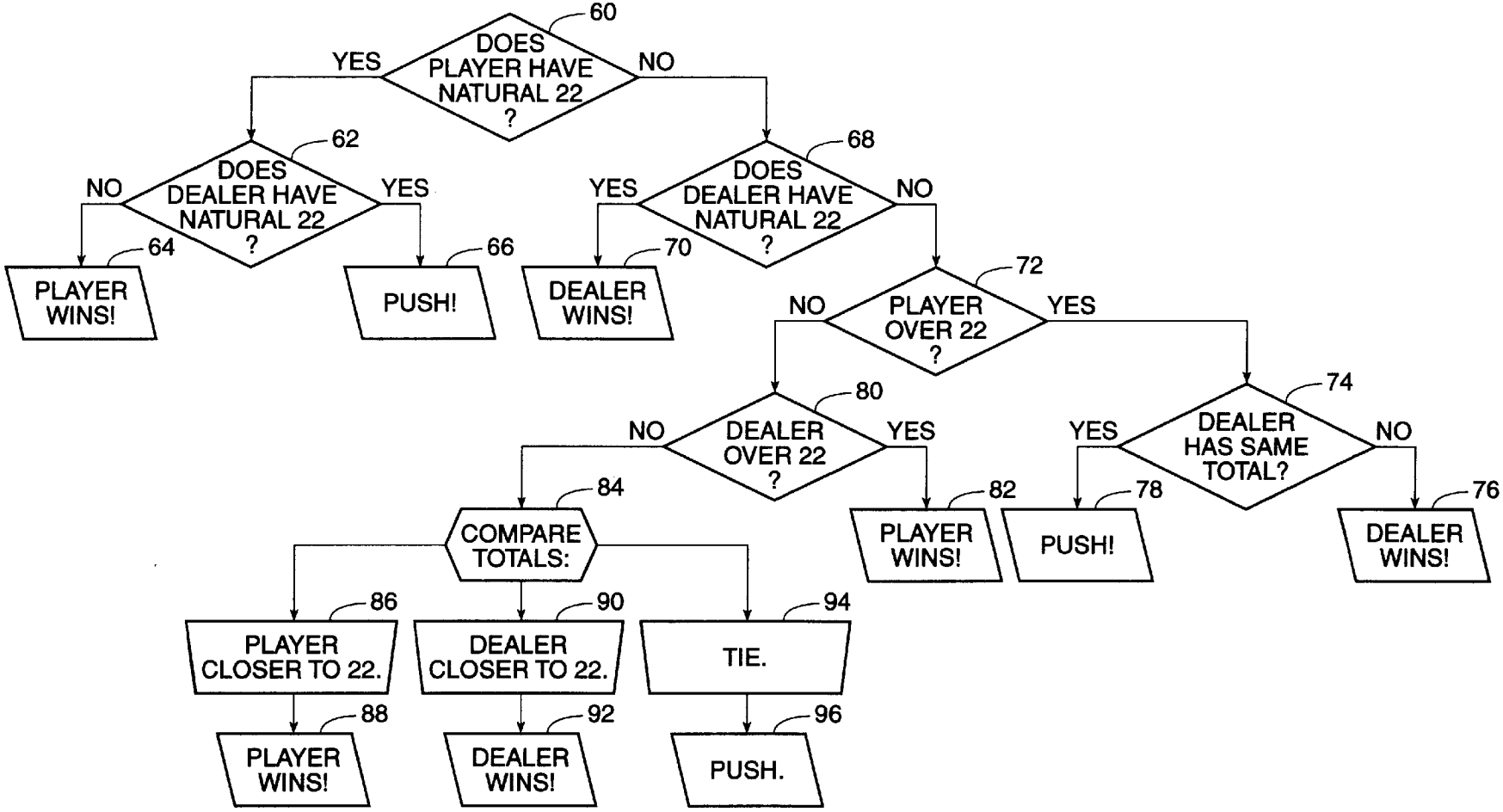
FIG. 3 is a flow chart illustrating one process of deciding winners according to a presently preferred embodiment of the present invention.

Referring now to FIG. 3, a flow chart illustrates the process of deciding winners from step 32 of FIG. 1. First, at step 60, it is determined whether the player has a natural 22 (or other target numerical value). If so, at decision diamond 62, it is determined whether the Dealer also has a natural 22 If not, then the player wins at 64, and if so, there is no winner and the hand is a "push" at 66.

If the player determines that (s)he does not have a natural 22 at step 60, evaluation proceeds to decision diamond 68, where, as in step 62, it is determined whether the Dealer has a natural 22. If the Dealer has a natural 22, the Dealer wins at 70. If the Dealer does not have a natural 22, evaluation proceeds to decision diamond 72, where it is determined if the player has gone over 22. If so, evaluation proceeds to decision diamond 74, where it is determined whether the Dealer has also gone over 22 with the same total as the player. If not, the Dealer wins at step 76. If the Dealer has gone over 22 with the same card total as the player, there is a "push" at step 78 and no winner between the Dealer and player. Note that, as previously disclosed, if decision diamond 72 determined that the player has gone over 22, an option could be to declare the Dealer the winner.

If the outcome at decision diamond 72 is that the player has not gone over 22, evaluation proceeds to decision diamond 80, where it is determined whether the Dealer has gone over 22. If the Dealer has gone over 22, the player wins at step 82. If the Dealer has not gone over 22, evaluation proceeds to step 84, where the card totals of the player and Dealer are compared. If, as shown in steps 86 and 88, the player is closer than the Dealer to the target numerical value, the player wins. If, as shown in steps 90 and 92, the Dealer is closer than the player to the target numerical value, the Dealer wins. If, as shown in steps 94 and 96, the player and the Dealer are tied, there is no winner and the hand is a "push".

Figure 4:
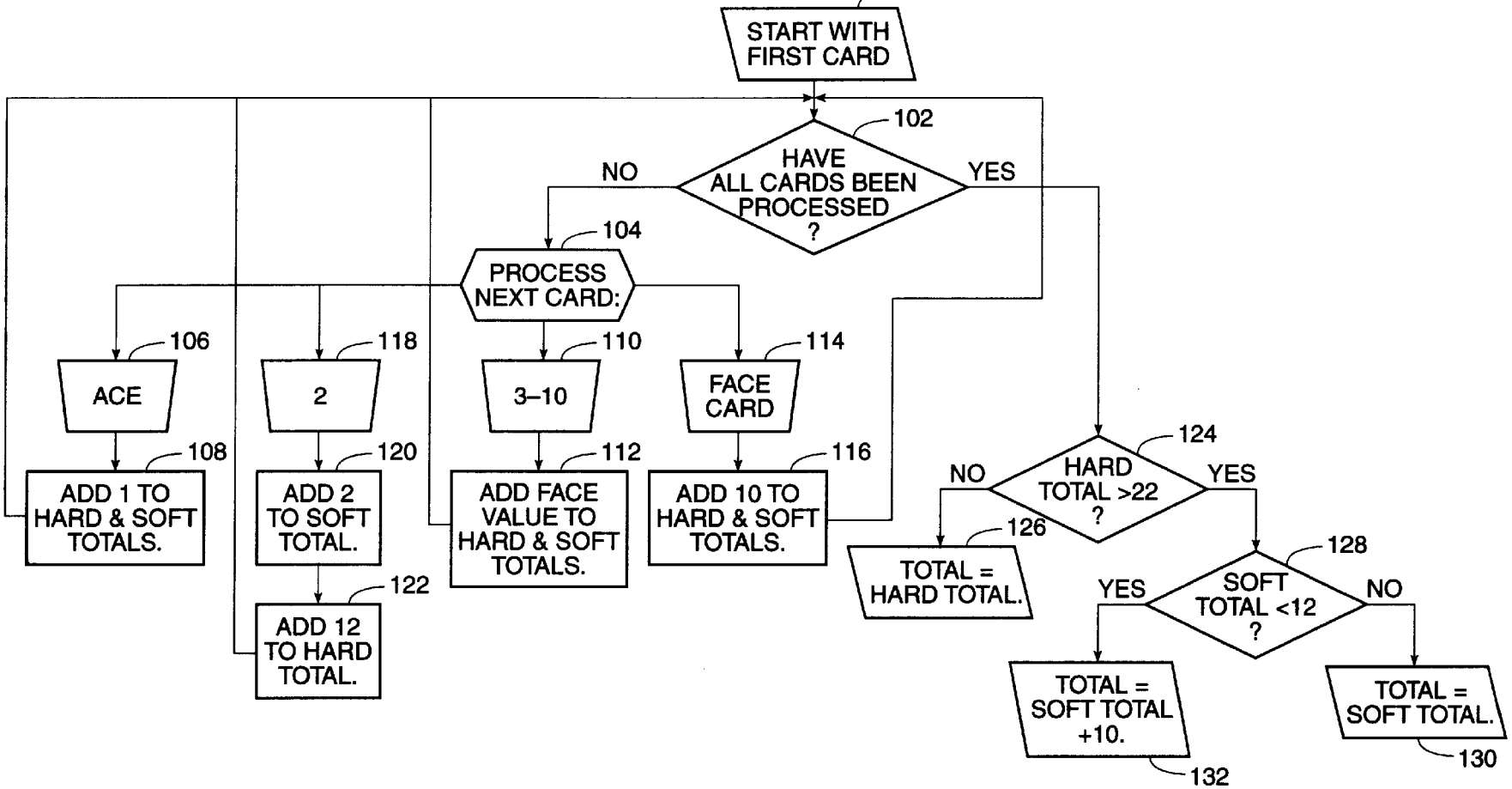
FIG. 4 is a flow chart illustrating how to evaluate a Newjack hand.

Referring now to FIG. 4, a flow chart illustrates how to evaluate a Newjack hand. At step 100, the first card is evaluated. At decision diamond 102, it is determined whether all cards have been evaluated. If not, evaluation proceeds to step 104, where the next card is processed. There are four possible scenarios. First, if the card is an ace at step 106, step 108 adds 1 to the hard and soft total numerical values of the hand. If the card is a 3 through a 10 at step 110, step 112 adds the face value of the card to the hard and soft total numerical values. If the card is a face (or "picture" card) at step 114, step 116 adds 10 to the hard and soft total numerical values. Finally, if the card is a deuce at step 118, 2 is added to the soft total at step 120 and 12 is added to the hard total at step 122. When the target numerical value is 22, the soft total is computed using 2 as the value of any deuce in the hand and the hard total is computed using 12 as the value of any deuce in the hand. For other target numerical values, Table II above shows the values to assign in steps 120 and 122. As shown in FIG. 4, after steps 108, 112, 116, and 122, evaluation returns to decision diamond 102 to determine if any cards remain to be processed.

When decision diamond 102 indicates that all cards in a hand have been processed, the hand evaluation algorithm proceeds to decision diamond 124 where it is determined whether the hard total exceeds the target numerical value. If not, the hard total is used at step 126. If so, the evaluation proceeds to decision diamond 128, where it is determined whether the soft total is less than 12. If not, the soft total is used at step 130. If, so, the soft total plus 10 is used at step 132.

The Newjack card game of the present invention may be played on any card table. However, it is contemplated that a table layout such as that depicted in FIG. 5 may be used. As may be seen from an examination of FIG. 5, the table 140 is preferably half of an oval (or a flattened semicircle). The House Dealer stands along the straight side 142 of the table. The table 140 may be fitted with a rectangular hole (not shown) into which the House Dealer may place a tray to hold chips.

There are a plurality of numbered Player Areas evenly spaced around the curved side of the table. Eight player positions numbered 144, 146, 148, 150, 152, 154, 156, and 158 are shown on the table illustrated in FIG. 5. Up to eight hands may be dealt on the table of FIG. 5, one to each Player Area. A hand is dealt to any Player Area where there is a player and a bet. The player who is acting as Dealer occupies one of the eight Player Areas.

In front of each Player Area is at least one Betting Spot, which are squares numbered 160, 162, 164, 166, 168, 170, 172, and 174. In front of each Betting Spot is circular Collection Spot with the letter "C" inside (reference numerals 176, 178, 180, 182, 184, 186, 188, and 190), and additional circle with the letter "J" inside (reference numerals 192, 194, 196, 198, 200, 202, 204, and 206). Collection Spots 176, 178, 180, 182, 184, 186, 188, and 190 may be used to make the house collection on each hand. Circles 192, 194, 196, 198, 200, 202, 204, and 206 are used as Jackpot Spots and may be used to place bets for the various jackpots associated with the game.

Figure 5:
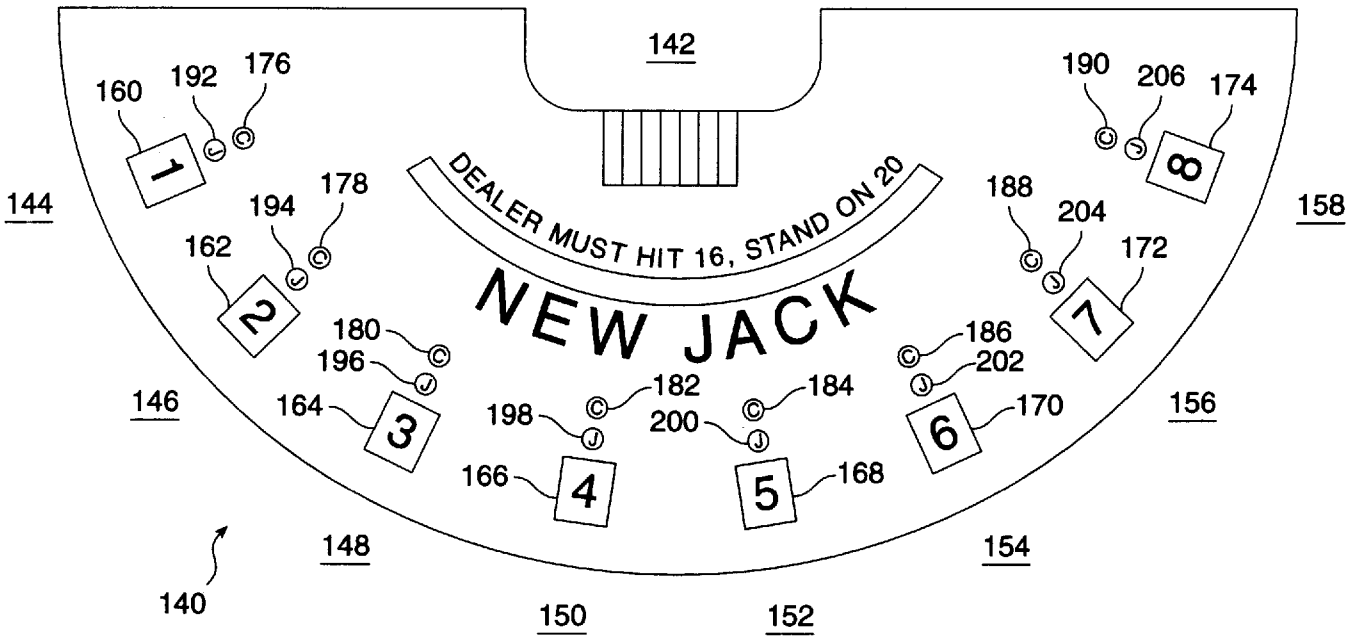
FIG. 5 is a diagram of a typical table layout for playing Newjack.

Those of ordinary skill in the art will recognize that the table shown in FIG. 5 is merely illustrative and the particular configuration shown therein is not necessary to play the game.

Figure 6:
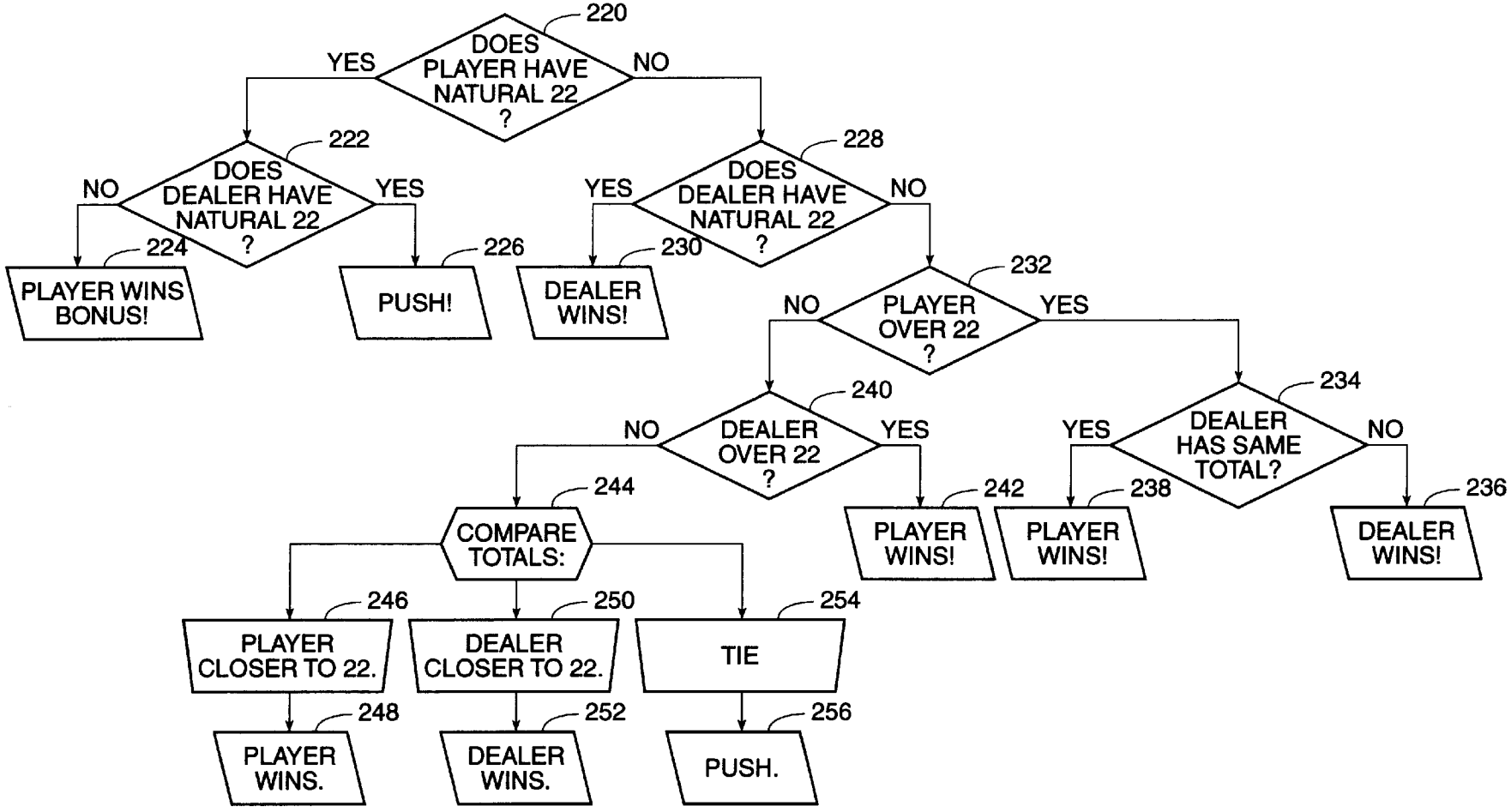
FIG. 6 is a flow chart illustrating an alternative process of deciding winners according to a presently preferred embodiment of the present invention.

Referring now to FIG. 6, a flow chart illustrates an alternative process of deciding winners from step 32 of FIG. 1. First, at step 220, it is determined whether the player has a natural 22 (or other target numerical value). If so, at decision diamond 222, it is determined whether the Dealer also has a natural 22. If not, then the player wins at 224, and if so, there is no winner and the hand is a "push" at 226.

If the player determines that (s)he does not have a natural 22 at step 220, evaluation proceeds to decision diamond 228, where, as in step 222, it is determined whether the Dealer has a natural 22. If the Dealer has a natural 22, the Dealer wins at 230. If the Dealer does not have a natural 22, evaluation proceeds to decision diamond 232, where it is determined if the player has gone over 22. If so, evaluation proceeds to decision diamond 234, where it is determined whether the Dealer has also gone over 22 with the same total as the player. If not, the Dealer wins at step 236. If the Dealer has gone over 22 with the same card total as the player, then the player wins at 238. Note that, as previously disclosed, if decision diamond 232 determined that the player has gone over 22, an option could be to declare the Dealer the winner.

If the outcome at decision diamond 232 is that the player has not gone over 22, evaluation proceeds to decision diamond 240, where it is determined whether the Dealer has gone over 22. If the Dealer has gone over 22, the player wins at step 242. If the Dealer has not gone over 22, evaluation proceeds to step 244, where the card totals of the player and Dealer are compared. If, as shown in steps 246 and 248, the player is closer than the Dealer to the target numerical value, the player wins. If, as shown in steps 250 and 252, the Dealer is closer than the player to the target numerical value, the Dealer wins. If, as shown in steps 254 and 256, the player and the Dealer are tied, there is no winner and the hand is a "push".

Figure 7:
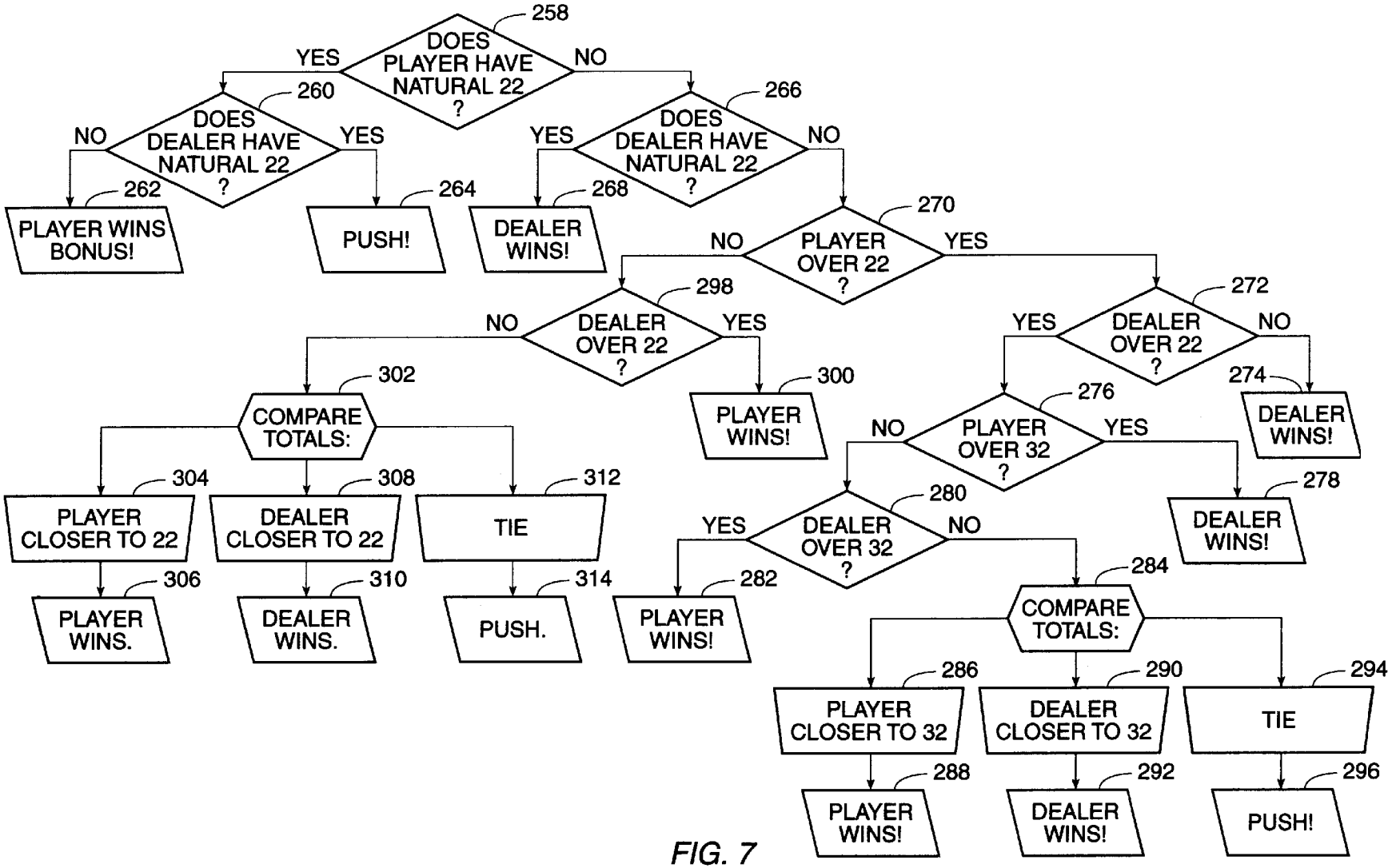
FIG. 7 is a flow chart illustrating an alternative process of deciding winners according to a presently preferred embodiment of the present invention.

Referring now to FIG. 7, a flow chart illustrates an alternative process of deciding winners from step 32 of FIG. 1. First, at step 258, it is determined whether the player has a natural 22 (or other target numerical value). If so, at decision diamond 260, it is determined whether the Dealer also has a natural 22. If not, then the player wins at 262, and if so, there is no winner and the hand is a "push" at 264.

If the player determines that (s)he does not have a natural 22 at step 258, evaluation proceeds to decision diamond 266, where, as in step 260, it is determined whether the Dealer has a natural 22. If the Dealer has a natural 22, the Dealer wins at 268. If the Dealer does not have a natural 22, evaluation proceeds to decision diamond 270, where it is determined if the player has gone over 22. If so, evaluation proceeds to decision diamond 272, where it is determined whether the Dealer has also gone over 22. If not, the Dealer wins at step 274. If the Dealer has gone over 22 at step 272, evaluation proceeds to decision diamond 276, where it is determined whether the player has gone over 32. If the player has gone over 32, then the Dealer wins at 278. If the player has not gone over 32 at step 276, evaluation proceeds to decision diamond 280, where it is determined whether the Dealer has gone over 32. If the Dealer has gone over 32, the player wins at 282. If the Dealer has not gone over 32 at step 280, evaluation proceeds to step 284, where the card totals of the player and Dealer are compared. If, as shown in steps 286 and 288, the player is closer than the Dealer to 32, the player wins. If, as shown in steps 290 and 292, the Dealer is closer than the player to 32, the Dealer wins. If, as shown in steps 294 and 296, the player and the Dealer are tied, there is no winner and the hand is a "push".

If the outcome at decision diamond 270 is that the player has not gone over 22, evaluation proceeds to decision diamond 298, where, as in step 272, it is determined whether the Dealer has gone over 22. If the Dealer has gone over 22, the player wins at step 300. If the Dealer has not gone over 22, evaluation proceeds to step 302, where the card totals of the player and Dealer are compared. If, as shown in steps 304 and 306, the player is closer than the Dealer to the target numerical value, the player wins. If, as shown in steps 308 and 310, the Dealer is closer than the player to the target numerical value, the Dealer wins. If, as shown in steps 312 and 314, the player and the Dealer are tied, there is no winner and the hand is a "push".

Figure 8:
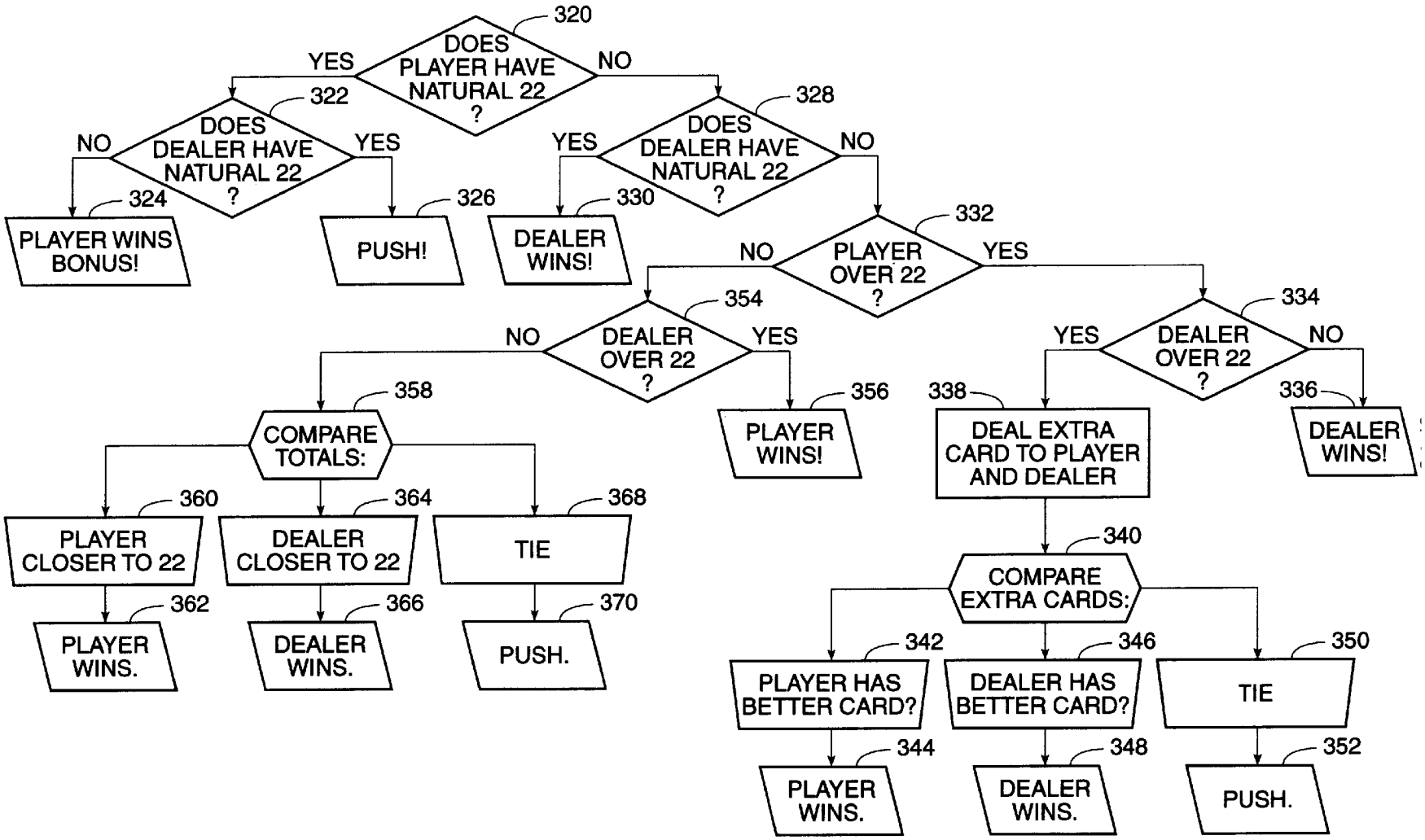
FIG. 8 is a flow chart illustrating an alternative process of deciding winners according to a presently preferred embodiment of the present invention.

Referring now to FIG. 8, a flow chart illustrates an alternative process of deciding winners from step 32 of FIG. 1. First, at step 320, it is determined whether the player has a natural 22 (or other target numerical value). If so, at decision diamond 322, it is determined whether the Dealer also has a natural 22. If not, then the player wins at 324, and if so, there is no winner and the hand is a "push" at 326.

If the player determines that (s)he does not have a natural 22 at step 320, evaluation proceeds to decision diamond 328, where, as in step 322, it is determined whether the Dealer has a natural 22. If the Dealer has a natural 22, the Dealer wins at 330. If the Dealer does not have a natural 22, evaluation proceeds to decision diamond 332, where it is determined if the player has gone over 22. If so, evaluation proceeds to decision diamond 334, where it is determined whether the Dealer has also gone over 22. If not, the Dealer wins at step 336. If the Dealer has gone over 22, then both the Dealer and the player are dealt one extra card at step 338. These cards can be dealt face up or face down as desired. In any case, after having dealt the cards at step 338, evaluation proceeds to step 340, where the cards of the player and Dealer are compared. If, as shown in steps 342 and 344, the player has a "better card" than the Dealer, the player wins. If, as shown in steps 346 and 348, the Dealer has a "better card" than the player, the Dealer wins. If, as shown in steps 350 and 352, the player and the Dealer are tied, there is no winner and the hand is a "push". Recall from the discussion above that a better card as used in this context may be either a higher or a lower card depending on the choice of the house. Also recall that at step 352, ties could alternatively go to the player or the Dealer rather than end in pushes as shown.

If the outcome at decision diamond 332 is that the player has not gone over 22, evaluation proceeds to decision diamond 354, where it is determined whether the Dealer has gone over 22. If the Dealer has gone over 22, the player wins at step 356. If the Dealer has not gone over 22, evaluation proceeds to step 358, where the card totals of the player and Dealer are compared. If, as shown in steps 360 and 362, the player is closer than the Dealer to the target numerical value, the player wins. If, as shown in steps 364 and 366, the Dealer is closer than the player to the target numerical value, the Dealer wins. If, as shown in steps 368 and 370, the player and the Dealer are tied, there is no winner and the hand is a "push".

Figure 9:
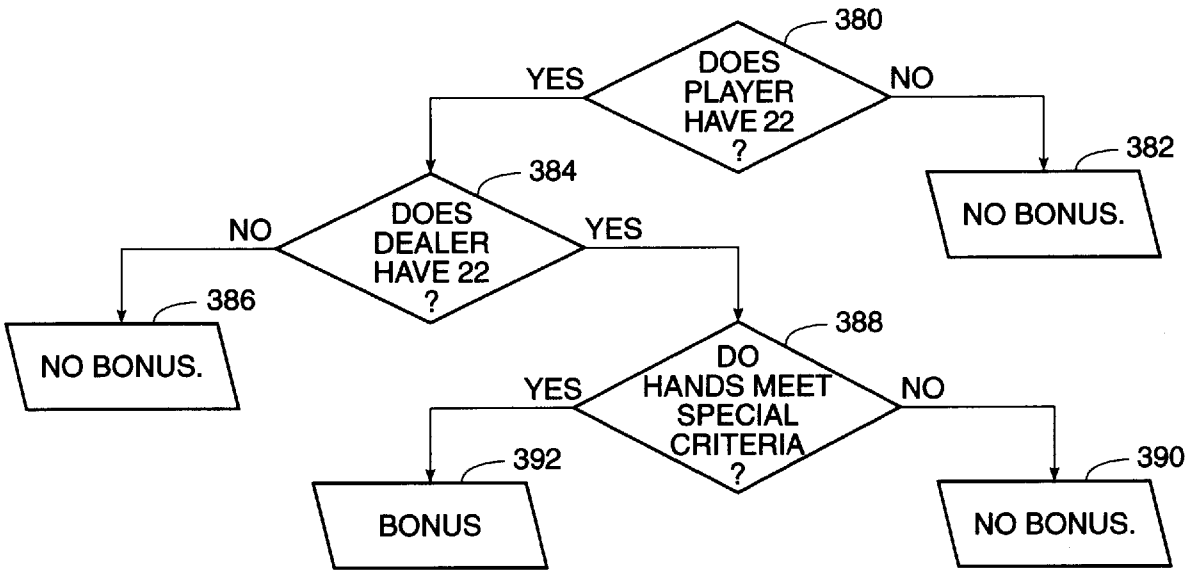
FIG. 9 is a flow chart illustrating an alternative process of awarding bonuses according to a presently preferred embodiment of the present invention.

Referring now to FIG. 9, a flow chart illustrating an alternative process of awarding bonuses according to the preferred embodiment of Newjack is presented. First, at step 380, it is determined whether the player has a natural 22 (or other target numerical value). If not, the player is awarded no bonus at 382. If so, at decision diamond 384, it is determined whether the Dealer also has a natural 22. If not, the player is awarded no bonus at 386.

If it is determined that the Dealer does have a natural 22 at step 384, evaluation proceeds to decision diamond 388, where it is determined whether the hands meet the "special criteria." If not, the player is awarded no bonus at 390. If so, the player is awarded a bonus at 392. Recall from the discussion above that the special criteria referred to here include paying bonuses on all ties on the target or only if one or the other or both of the parties have drawn cards. The resulting options are: 1) pay on all ties on the target; 2) pay only if the player has drawn cards and they tie on the target; 3) pay only if the Dealer has drawn cards and they tie on the target; or 4) pay only if both the Dealer and the player have drawn cards and they tie on the target.

Figure 10:
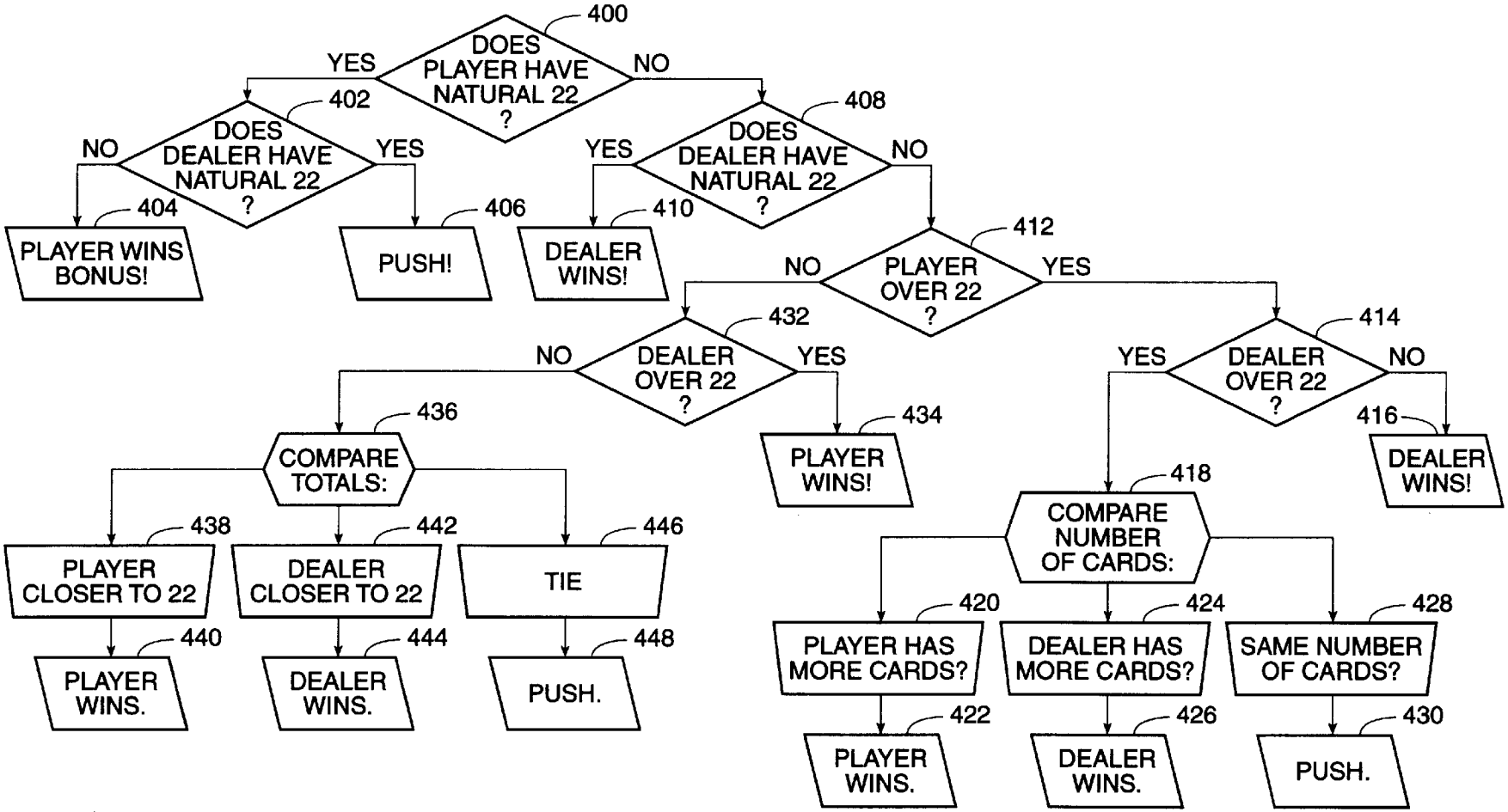
FIG. 10 is a flow chart illustrating an alternative process of deciding winners according to a presently preferred embodiment of the present invention.

Referring now to FIG. 10, a flow chart illustrates the alternative process of deciding winners from step 32 of FIG. 1. First, at step 400, it is determined whether the player has a natural 22 (or other target numerical value). If so, at decision diamond 402, it is determined whether the Dealer also has a natural 22. If not, then the player wins at 404, and if so, there is no winner and the hand is a "push" at 406.

If the player determines that (s)he does not have a natural 22 at step 400, evaluation proceeds to decision diamond 408, where, as in step 402, it is determined whether the Dealer has a natural 22. If the Dealer has a natural 22, the Dealer wins at 410. If the Dealer does not have a natural 22, evaluation proceeds to decision diamond 412, where it is determined if the player has gone over 22. If so, evaluation proceeds to decision diamond 414, where it is determined whether the Dealer has also gone over 22. If not, the Dealer wins at step 416. If the Dealer has gone over 22 at step 414, evaluation proceeds to step 418, where the total number of cards in each of the hands of the player and Dealer are compared. If, as shown in steps 420 and 422, the player has a higher number of cards than the Dealer, the player wins. If, as shown in steps 424 and 426, the Dealer has a higher number of cards than the player, the Dealer wins. If, as shown in steps 428 and 430, the player and the Dealer have the same number of cards, there is no winner and the hand is a "push". Recall from the discussion above that at step 430, ties could alternatively go to the player or the Dealer rather than end in pushes as shown.

If the outcome at decision diamond 412 is that the player has not gone over 22, evaluation proceeds to decision diamond 432, where it is determined whether the Dealer has gone over 22. If the Dealer has gone over 22, the player wins at step 434. If the Dealer has not gone over 22, evaluation proceeds to step 436, where the card totals of the player and Dealer are compared. If, as shown in steps 438 and 440, the player is closer than the Dealer to the target numerical value, the player wins. If, as shown in steps 442 and 444, the Dealer is closer than the player to the target numerical value, the Dealer wins. If, as shown in steps 446 and 448, the player and the Dealer are tied, there is no winner and the hand is a "push".

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A method of playing a card game comprising:

providing at least one deck of standard playing cards;

establishing numerical values for each card in the deck;

identifying one player as the Dealer;

requiring each player and the Dealer to wager a sum of money before play begins;

dealing each player and the Dealer two cards to start, where these cards may be dealt face up, face down, or one face up and one face down;

optionally dealing one or more cards to each player at his/her request;

optionally adding one or more cards to the Dealer's hand at his/her request; and comparing the numerical value of each player's hand in turn to the Dealer's hand and awarding the money to the one who has the closer numerical value to a specified target numerical value, wherein if both the Dealer's hand and the player's hand have the same numerical value either under or over the target numerical value, or if both the Dealer's hand and the player's hand have a numerical value that exceeds the target numerical value, determining if there is a winner according to predetermined criteria, wherein said predetermined criteria where both the Dealer's hand and the player's hand have the same numerical value that exceeds the target numerical value is that the player wins, and wherein said predetermined criteria where in all other cases where both the Dealer's hand and the player's hand have a numerical value that exceeds the target numerical value is that the Dealer wins.

2. A method of playing a card game comprising:

providing at least one deck of standard playing cards;

establishing numerical values for each card in the deck;

identifying one player as the Dealer;

requiring each player and the Dealer to wager a sum of money before play begins;

dealing each player and the Dealer two cards to start, where these cards may be dealt face up, face down, or one face up and one face down;

optionally dealing one or more cards to each player at his/her request;

optionally adding one or more cards to the Dealer's hand at his/her request; and comparing the numerical value of each player's hand in turn to the Dealer's hand and awarding the money to the one who has the closer numerical value to a specified target numerical value, wherein if both the Dealer's hand and the player's hand have the same numerical value either under or over the target numerical value, or if both the Dealer's hand and the player's hand have a numerical value that exceeds the target numerical value, determining if there is a winner according to predetermined criteria, wherein said predetermined criteria where both the Dealer's hand and the player's hand have a numerical value that exceeds the target numerical value is that the winner is determined by reference to a specified higher target numerical value and the one who has the closer numerical value to the higher target numerical value without going over wins.

3. The method of claim 2 wherein any player or Dealer whose hand has a numerical value that exceeds the target numerical value may draw additional cards trying to get closer to the higher target numerical value.

4. A method of playing a card game comprising:

providing at least one deck of standard playing cards;

establishing numerical values for each card in the deck;

identifying one player as the Dealer;

requiring each player and the Dealer to wager a sum of money before play begins;

dealing each player and the Dealer two cards to start, where these cards may be dealt face up, face down, or one face up and one face down;

optionally dealing one or more cards to each player at his/her request;

optionally adding one or more cards to the Dealer's hand at his/her request; and comparing the numerical value of each player's hand in turn to the Dealer's hand and awarding the money to the one who has the closer numerical value to a specified target numerical value, wherein if both the Dealer's hand and the player's hand have the same numerical value either under or over the target numerical value, or if both the Dealer's hand and the player's hand have a numerical value that exceeds the target numerical value, determining if there is a winner according to predetermined criteria, wherein said predetermined criteria where both the Dealer's hand and the player's hand have a numerical value that exceeds the target numerical value is that a second contest involving additional cards is held to determine the winner.

5. The method of claim 4 wherein said second contest involves dealing both the Dealer and the player a single card and using the numerical value of that card to determine the winner according to predetermined criteria.

6. The method of claim 5 wherein said predetermined criteria is that the Dealer or the player having the card with the higher numerical value wins.

7. The method of claim 5 wherein said predetermined criteria is that the Dealer or the player having the card with the lower numerical value wins.

8. The method of claim 5 wherein said predetermined criteria is that the Dealer wins ties.

9. The method of claim 5 wherein said predetermined criteria is that the player wins ties.

10. The method of claim 5 wherein said predetermined criteria is that ties are pushes.

11. A method of playing a card game comprising:

providing at least one deck of standard playing cards;

establishing numerical values for each card in the deck;

identifying one player as the Dealer;

requiring each player and the Dealer to wager a sum of money before play begins;

dealing each player and the Dealer two cards to start, where these cards may be dealt face up, face down, or one face up and one face down;

optionally dealing one or more cards to each player at his/her request;

optionally adding one or more cards to the Dealer's hand at his/her request; and comparing the numerical value of each player's hand in turn to the Dealer's hand and awarding the money to the one who has the closer numerical value to a specified target numerical value, wherein if both the Dealer's hand and the player's hand have the same numerical value either under or over the target numerical value, or if both the Dealer's hand and the player's hand have a numerical value that exceeds the target numerical value, determining if there is a winner according to predetermined criteria, wherein said predetermined criteria where both the Dealer's hand and the player's hand have the same numerical value that equals the target numerical value is that the player wins and is paid a bonus if predetermined special criteria are met.

12. The method of claim 11 wherein said predetermined special criteria is that both the Dealer and the player tie on the target numerical value.

13. The method of claim 11 wherein said predetermined special criteria is that the Dealer drew cards.

14. The method of claim 11 wherein said predetermined special criteria is that the player drew cards.

15. The method of claim 11 wherein said predetermined special criteria is that both the Dealer and the player drew cards.

16. A method of playing a card game comprising:

providing at least one deck of standard playing cards;

establishing numerical values for each card in the deck;

identifying one player as the Dealer;

requiring each player and the Dealer to wager a sum of money before play begins;

dealing each player and the Dealer two cards to start, where these cards may be dealt face up, face down, or one face up and one face down;

optionally dealing one or more cards to each player at his/her request;

optionally adding one or more cards to the Dealer's hand at his/her request; and comparing the numerical value of each player's hand in turn to the Dealer's hand and awarding the money to the one who has the closer numerical value to a specified target numerical value, wherein if both the Dealer's hand and the player's hand have the same numerical value either under or over the target numerical value, or if both the Dealer's hand and the player's hand have a numerical value that exceeds the target numerical value, determining if there is a winner according to predetermined criteria, wherein said predetermined criteria where both the Dealer's hand and the player's hand have a numerical value that exceeds the target numerical value is that the Dealer or the player having the greater number of cards in his/her hand wins.

17. The method of claim 16 wherein said predetermined criteria where both the Dealer and the player have the same number of cards is that the hand is a push.

18. The method of claim 16 wherein said predetermined criteria where both the Dealer and the player have the same number of cards is that the Dealer wins ties.

19. The method of claim 16 wherein said predetermined criteria where both the Dealer and the player have the same number of cards is that the player wins ties.

* * * * *